US008334785B1

(12) United States Patent
Zetts

(10) Patent No.: US 8,334,785 B1
(45) Date of Patent: Dec. 18, 2012

(54) FIRE ALERT SYSTEM WITH SEQUENTIAL DELAY AND EXTERNAL INDICATION

(76) Inventor: Stephen Zetts, Youngstown, OH (US)

( * ) Notice: Subject to any disclaimer, the term of this patent is extended or adjusted under 35 U.S.C. 154(b) by 496 days.

(21) Appl. No.: 12/658,417

(22) Filed: Feb. 12, 2010

(51) Int. Cl.
*G08B 21/00* (2006.01)

(52) U.S. Cl. ..... 340/691.5; 340/584; 340/628; 340/691.4; 340/309.16

(58) Field of Classification Search ..... 340/577, 340/578, 584, 691, 693, 309.16, 628–630, 340/691.1–691.5, 693.1
See application file for complete search history.

(56) References Cited

U.S. PATENT DOCUMENTS

| | | | |
|---|---|---|---|
| 4,300,133 | A | 11/1981 | Solomon |
| 4,788,530 | A | 11/1988 | Bernier |
| 5,659,292 | A | 8/1997 | Tice |
| 5,745,040 | A | 4/1998 | Loughridge |
| 2001/0038337 | A1 | 11/2001 | Wickstead et al. |

*Primary Examiner* — Jeffery Hofsass
(74) *Attorney, Agent, or Firm* — Harpman & Harpman

(57) ABSTRACT

A fire and smoke heat detector alarm device that employs a combination of indoor and outdoor alarms with a user delay and off access control activation input. The warning alarm device has interior and remote control access including battery backup and pro-active threat mitigation of optional gas supply cut-off.

9 Claims, 2 Drawing Sheets

FIRE ALERT SYSTEM WITH SEQUENTIAL DELAY AND EXTERNAL INDICATION

BACKGROUND OF THE INVENTION

1. Technical Field

This device and integrated system relates to alarm warning devices in residential homes for the detection of smoke and associated elements of fire by emitting an audible alarm to warn the occupants and neighbors of the fire hazard or potential problems by activation of the device.

2. Description of Prior Art

Prior art devices of this type have been directed to a number of different smoke alarms; see for example U.S. Pat. Nos. 4,300,133, 4,788,530, 5,659,292, 5,745,040 and Patent Publications 2001/0038337 A1.

In U.S. Pat. No. 4,300,133, a smoke detector is disclosed having a modulation technique for smoke energy source and detector parameter changes to distinguish a fire source as opposed to a tobacco source.

U.S. Pat. No. 4,788,530 illustrates a remote switching device for smoke detection so upon a false alarm the user can activate a holding relay to disconnect the detector, stopping the alarm.

U.S. Pat. No. 5,659,292 claims an apparatus with a fire sensor and non-fire sensor such as a temperature and humidity device. This will provide an alert as to the potential of fire conditions to exist.

U.S. Pat. No. 5,745,040 shows an outdoor alerting device for smoke alarms in which an audible alarm and flashing light are activated on an outdoor location by an indoor smoke alarm by use of a microphone and amplifier for the audio outdoor speaker.

U.S. Patent Publication 2001/0038337 discloses a smoke alarm with time out feature using a remote transmitter activator and timer disabling the audio and visual alarm.

SUMMARY OF THE INVENTION

A smoke and fire alarm system providing for user selectable alarm activation delay and reset feature once the alarm has been initially activated. Interior and exterior structure alarms employ visual and audio alarm elements with integrated activation delay allowing the user to respond before the outside alarms to be activated. The alarm system provides an actuation interface with fuel supply cut-offs with multiple controls and command options for delay, reset or cancel the alarms prior post activated.

DETAILED DESCRIPTION OF THE INVENTION

Figure 1:
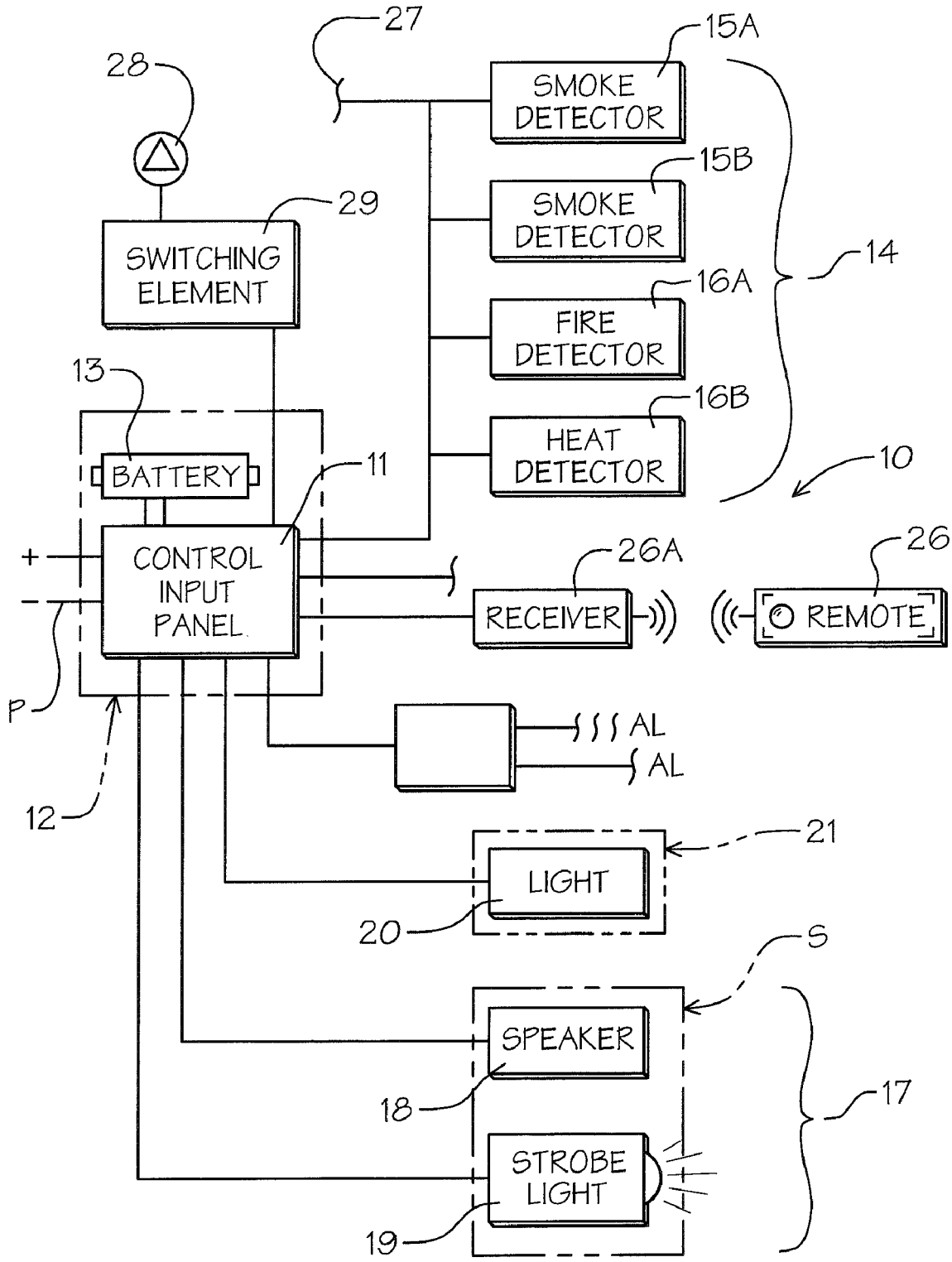
FIG. 1 is a schematic block flow diagram illustrating the alarm system components.

Referring to FIG. 1 of the drawings, a fire alert warning system device 10 of the invention can be seen having a main control input panel 11 with an integrated programmable activation control circuit 12 indicated by broken inclusion lines thereabout. The activation control circuit 12 has a main power source P with a back-up battery 13 emergency power for activation when needed. The system 10 provides multiple fire detection sensors 14 as illustrated in the primary preferred embodiment has a smoke detector 15A and 15B, a fire detector (ionization sensing) 16A and a heat sensor detector 16B. This will provide the system 10 with multiple modes of detection and alert fire source application. The command and control circuit 12 is in communication with the detection sensors 14 and multiple system alarm components 17 positioned on the outside of the structure S indicated by perimeter broken lines as seen in FIG. 1 of the drawings.

The alarm components 17 are comprised of both audio output device 18 such as a speaker and a visual illumination device 19 such as a strobe light. An interior audible alarm 20 of the detection sensors 14 and indicator light 21 on the control panel inside the structure as will be disclosed in detail hereinafter to confirm the system activation for the user during an alert.

The interior alarm indicator 21 of the alarm circuit 12 is activated when smoke, heat or fire is detected by the respective sensors 15A, 15B, 16A and 16B and will then initiate a pre-programmed alarm activation count down delay time T before the outside alarms 18 and 19 are activated. The countdown delay T is indicated on the main control panel 11 in LCD display 24.

Figure 2:
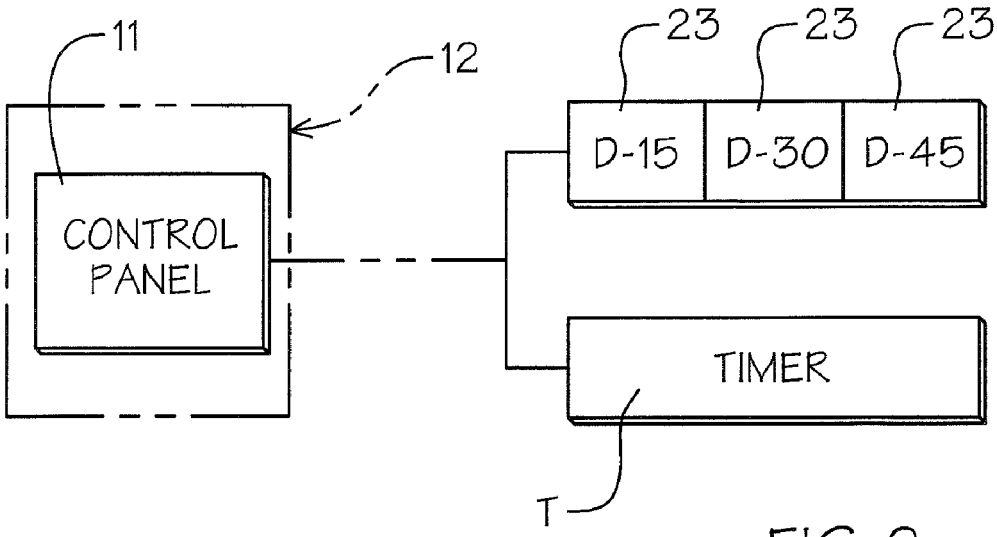
FIG. 2 is a schematic block flow diagram illustrating the delay feature sequence of the system.
Figure 3:
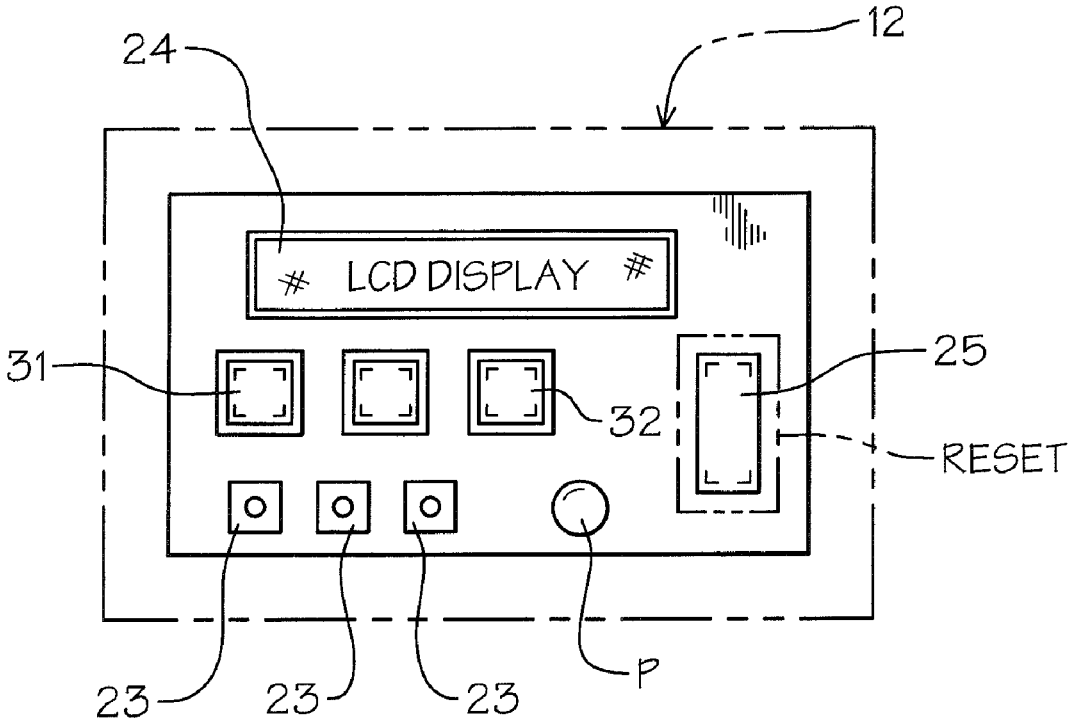
FIG. 3 is graphic illustration of the system command and control activation panel interface.

The effective time delay T "countdown timer" can be user programmed as illustrated in FIG. 2 of the drawings as in this example from fifteen seconds to up to forty-five seconds for effective activation delay. This is achieved by fixed pre-programmed time delay input selection buttons 23A, 23B, and 23C or alternately as a sequential selection indicated by a visual time indicator in the LCD display 24 in the control panel 11 as will be understood by those skilled in the art.

A primary user activation delay recess button 25 on the control panel 11 will preferably be larger than the other control access user inputs and in this example illuminated with a flashing sequence to help draw the user's attention thereto.

The reset button 25 is central to the primary mission of the alarm control system 10 of the invention since by activation it will cancel the outside alarms 18 and 19 before activation as hereinbefore described. As noted, the select user activation sequence of the system 10 can thus be reset if activation inadvertently occurs by extraneous smoke or heat sources such as cooking, for example.

Additionally, a portable hand held emergency remote control device 26 is provided shown in FIG. 1 of the drawings which can be carried by the user and provides by digitally encoded command transmission to a receiver 26A activation access to the central controller 11 for system operational access for emergencies such as medical accident, for example.

The fire alert warning system 10 of the invention has additional activation circuit elements indicated generally at 27 for additional multiple detection sensors 14 as may be required in different operational venue parameters beyond that of the primary sensors described. Additionally an emergency gas shut-off valve 28 which, in this example, is controlled by a direct circuit interface and relay in response to direct control input, as noted. A sound source (fire/smoke detectors when activated) will signal the control panel 11 which will in turn after program delay time has expired activate the outside audible and light alarms 18 and 19. A switching element 29 may also trip the gas shut-off valve 28 upon detection of the outside audible alarm as hereinbefore described and understood by those skilled in the art.

The system 10 of the invention may be fitted with heat resistant wires within the structure and emergency control panel lighting upon activation in the event that power is not available through its primary power source and the system must rely on the back-up battery 13 as hereinbefore described.

Secondary user control activation is provided allowing for independent activation for non-fire related emergencies, such as health emergencies wherein the outside alarm elements 17 can be activated by the user by the remote control emergency device transmitter 26 which will alert the neighbors for help. The control panel 11 also has a number of system control input buttons beyond the primary flashing reset button 25 and delay timing buttons 23A, 23B and 23C. In this example, an "away" activation button 31 would provide an instance outside alarm 17 activation upon fire detection sensor initiation with a slow beeping tone for alerting the user upon return that an event has occurred and that the system needs to be reset, also viewable in the LCD display screen 24. Additionally, a large sleep button 32 is provided which is preferably green in color with interior illumination. Once selected, the sleep button would stay illuminated so as to be visible upon awakening with a "need to program" message in the LCD controller panel display 24 reminding the user that the operational system needs to be addressed before proceeding with the activities of the day.

It will thus be seen that a new and novel fire alert warning and delay system device 10 of the invention has been illustrated and described and that the system will provide the user while within the structure to effectively deactivate the alarm once initiated by the input of a pre-programmed time delay before the primary outside alarms 17 are activated. This control basis panel 11 institutes a number of different sequential alarm sequence action including an away button, sleep button, independent pre-programmed time delay alarm as well as auxiliary lighting, automatic source ignition shut-off valves, all within the parameters of a single independent inclusive alarm system which provides the user additional security and control.

It will be apparent to those skilled in the art that various changes and modifications may be made thereto without departing from the spirit of the invention.

Therefore I claim:

1. An alarm device for detecting the product of combustion in a structure with exterior alarms comprises, a central alarm control panel having an activation detection circuit, access input switch selection panel and alarm reset button on said control panel, smoke, fire and heat detectors in communication with said activation detection circuit in said structure, exterior audible and visual alarms in communication with said activation circuit, said smoke detectors having independent interior audio alarms, a delay alarm activation timer in communication with said exterior alarms, said activation circuit and said control activation panel, user time determinate input delay access switches in communication with said delay alarm activation timer and said smoke detectors interior audio alarms, remote control emergency alarm control access activator device in telecommunication with said alarm control activation circuit and having an independent source of power.

2. The alarm device set forth in claim 1 wherein said alarm control panel comprises, multiple user input switches, LCD display screen and status indicator lights.

3. The alarm device set forth in claim 1 wherein said delay alarm activation timer comprises, a user programmable time delay circuit having preset sequential time values in response to said delay access switches.

4. The alarm device set forth in claim 1 wherein said smoke detector comprises, a smoke activated audible alarm in communication with said activation detection circuit.

5. The alarm device set forth in claim 1 wherein said delay alarm activation timer further comprise, a smoke alarm reset delay for said independent interior audio alarms of said smoke detectors.

6. The alarm device set forth in claim 1 wherein said remote control emergency alarm telecommunication comprises, an electronic transmitter and a receiver, said receiver is interconnected to said activation detection circuit for emergencies.

7. The alarm device set forth in claim 1 wherein said source of power comprises standard available line voltage and back-up battery upon power failure.

8. The alarm device set forth in claim 2 wherein said multiple user input switches comprises, said reset button, and away button overriding said alarm time delay for instant direct alarm activation in response to said smoke and heat detectors.

9. The alarm device set forth in claim 2 wherein said multiple user input switches further comprise, a user sleep button indicator for determinant use action after a time delay user interface.

* * * * *